US006321726B1

(12) United States Patent
Khami et al.

(10) Patent No.: US 6,321,726 B1
(45) Date of Patent: Nov. 27, 2001

(54) CARBON CANISTER SPRING PLATE

(75) Inventors: Roger Khami, Troy; Dawn Clancy, South Lyon; Ljupco Dimitrievski, Macomb Township; Thomas Goebel, Monroe, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/595,694

(22) Filed: Jun. 16, 2000

(51) Int. Cl.[7] ..... F02M 33/02
(52) U.S. Cl. ..... 123/519; 55/385.3
(58) Field of Search ..... 123/516, 518, 123/519; 55/495, 385.3, 385.4, 492, 501, 510–11

(56) References Cited

U.S. PATENT DOCUMENTS

| | | | | |
|---|---|---|---|---|
| 3,348,692 | | 10/1967 | Balogh . | |
| 3,411,629 | | 11/1968 | Wilber et al. . | |
| 3,730,158 | * | 5/1973 | St. Amand | 123/519 |
| 3,870,492 | | 3/1975 | Guild . | |
| 4,306,894 | * | 12/1981 | Fukami et al. | 55/316 |
| 4,381,929 | * | 5/1983 | Mizuno et al. | 55/316 |
| 4,758,255 | | 7/1988 | Yamada et al. . | |
| 4,986,840 | * | 1/1991 | Mori et al. | 55/316 |
| 5,098,453 | * | 3/1992 | Turner et al. | 123/519 |
| 5,122,172 | * | 6/1992 | Sherwood et al. | 123/519 |
| 5,174,938 | * | 12/1992 | Ito et al. | 264/112 |
| 5,718,209 | * | 2/1998 | Scardino et al. | 123/519 |
| 5,779,773 | | 7/1998 | Cam et al. . | |

* cited by examiner

*Primary Examiner*—Thomas N. Moulis
(74) *Attorney, Agent, or Firm*—John E. Kajander

(57) ABSTRACT

A spring compression plate (40), (46), (50), (60) for retaining the active material (28) that adsorbs fuel vapor in a fuel vapor storage canister (16). The plate (40), (46), (50), (60) has a wiper seal (44), (54), (68), (80) around its outer periphery that is capable of moving upwardly or downwardly within the shell body (34) of the canister (16) while maintaining substantial sealing to an inside portion of said shell body (34), thereby preventing leakage of the active material (28) when the canister (34) expands or contracts thermally. The spring compression plate (40), (46), (50), (60) is designed to maintain the integrity of the active material (28) over the lifetime of the vehicle in which it is placed. The spring compression plate (40), (46), (50), (60) also contains perforations (42) , (52), (66), (78) for allowing fuel vapor and air to freely flow through the canister (16).

28 Claims, 4 Drawing Sheets

CARBON CANISTER SPRING PLATE

TECHNICAL FIELD

The present invention relates generally to fuel systems and more particularly to a canister for adsorbing fuel vapors in a fuel system.

BACKGROUND

Fuel evaporative control systems are typically used in automobiles to prevent fuel tank vapors from entering the atmosphere. Fuel vapors are typically generated when fuel is introduced into a fuel tank, or when fuel sloshes or splashes in a fuel tank as a result of road conditions or vibrations, or operator driving dynamics.

Contained within the evaporative control systems are carbon canisters. The carbon canisters trap fuel vapor when an engine is not running. The canisters are filled with activated charcoal granules that are capable of adsorbing fuel vapors.

When the engine of an automobile is running, the intake manifold vacuum acts on the charcoal canister purge line. This causes fresh air to flow through the filter and into the canister. The fresh air picks up the stored fuel vapors and carries them through a fuel vapor line. The vapors enter the intake manifold and are introduced into the combustion chambers for ignition with injected fuel.

Typically, as described above, carbon canisters are filled with pelletized or granular carbon. Pressure is applied against a bed compression plate, using a coil or spring leaf spring or springs to maintain carbon bed integrity, as the bed tends to compact during its useful life. Molded-in spring posts are typically used to hold the springs or coils within the canister.

One problem with typical carbon canister constructions is that the carbon canisters are made of molded plastic and the bed compression plates are made of of metal. Due to the difference in materials, the canister and plate expand and contract at different rates, creating the possibility that the carbon granules or pellets may leak.

Another problem with typical carbon canister constructions is that the molded-in spring posts are difficult to manufacture. These posts are difficult to mold into acceptable shapes and sizes, and also require long cure cycle times.

Further, the current designs of carbon canisters require a complicated support structure to maintain the carbon bed integrity. Springs, such as a strip leaf spring, or coils welded to the bottom of the bed apply pressure to the bed compression plates to maintain carbon bed integrity, as the bed tends to compact during its useful life.

It is thus highly desirable to limit or eliminate carbon pellet leakage resulting from expansion or contraction of the carbon canister relative to the bed compression plate.

It is also highly desirable, from a design and manufacturing standpoint, to simplify the design of the carbon canister systems by eliminating molded-in spring posts and to limit the amount of parts used for maintaining carbon bed integrity.

SUMMARY OF THE INVENTION

It is thus one object of the present invention to limit or eliminate carbon pellet leakage resulting from expansion or contraction of the carbon canister relative to the bed compression plate.

It is another object of the present invention to simplify the design of the carbon canister systems by eliminating molded-in spring posts and to minimize the number of parts used for maintaining carbon bed integrity.

The present invention simplifies the design of a carbon canister assembly by combining the bed compression plate and spring into one single part. This new design aids in the manufacturing of the carbon canister by simplifying the molding of the carbon canister due to the elimination of the molded in spring post. The new design provides constant mechanical pressure on the carbon bed within the canister over the life of the vehicle.

Other objects and advantages of the present invention will become apparent upon considering the following detailed description and appended claims, and upon reference to the accompanying drawings.

DESCRIPTION OF THE PREFERRED EMBODIMENTS(S)

Figure 1:
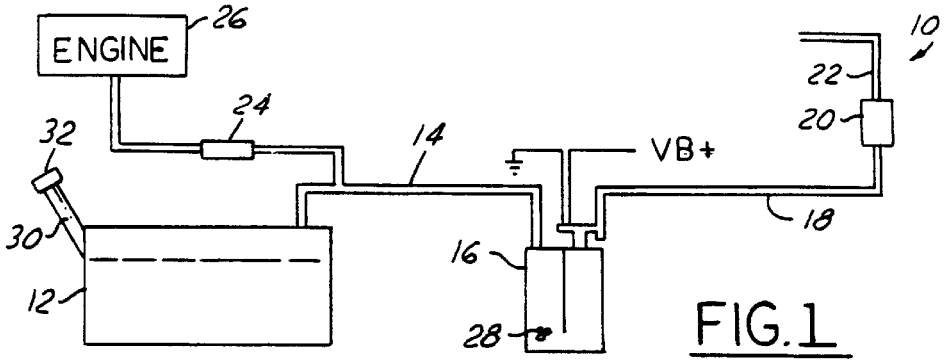
FIG. 1 is a perspective view of a fuel vapor storage system.

Referring now to FIG. 1, a fuel vapor storage system 10 is shown having as its major components a fuel tank 12, a fuel vapor line 14, a fuel vapor storage canister 16, a canister vent valve 18, a dust/filter separator 20, a fresh air vent line 22, and a vapor management valve 24.

Fuel vapor generation is a function of many factors. For instance, as the temperature increases in the fuel tank 12, more fuel vapor is generated. Also, as fuel levels within the fuel tank 12 decrease, or when fuel is sloshing within the fuel tank 12, excess fuel vapor is generated. Perhaps the greatest source of fuel vapor generation occurs when fuel is added to the fuel tank 12 through the gas line 30 when the gas cap 32 is removed.

When an internal combustion engine 26 is not running, fuel vapor generated within the fuel tank 12 travels through the fuel vapor line 14 into the fuel vapor storage canister 16. The fuel vapor storage canister 16 contains an active material (preferably carbon pellets 28 or granules) for adsorbing fuel vapor. The capacity of fuel vapor adsorption by the carbon pellets 28 is a function of the composition and surface area of the carbon pellets 28 within the canister 16. If the amount of fuel vapor exceeds the capacity of fuel vapor adsorption capability of the carbon pellets 22, excess fuel vapor is vented through the canister vent valve 18, the dust/filter separator 20, and out the fresh air vent line 22. When the engine 26 is not running, the vapor management valve 24 is closed, thus preventing fuel vapor from entering the engine 26 from the fuel vapor line 14 and preventing fuel vapor not combusted in the engine 26 from reentering the fuel line 14.

When the engine 26 is running, the vapor management valve 24 is opened. An intake manifold vacuum acts on the fuel vapor storage system 10. This vacuum causes fresh air to flow into the fresh air vent line 22, through the dust/filter separator 20 and canister vent valve 18, and into the canister 16. The fresh air picks up the stored fuel vapors (the fuel vapor is deadsorbed by the carbon pellets 28) in the canister 16 and carries them through a fuel vapor line 14. The vapors pass through the open vapor management valve 24 and enter the intake manifold (not shown) of the engine 26 and into the combustion chambers for burning.

Figure 2:
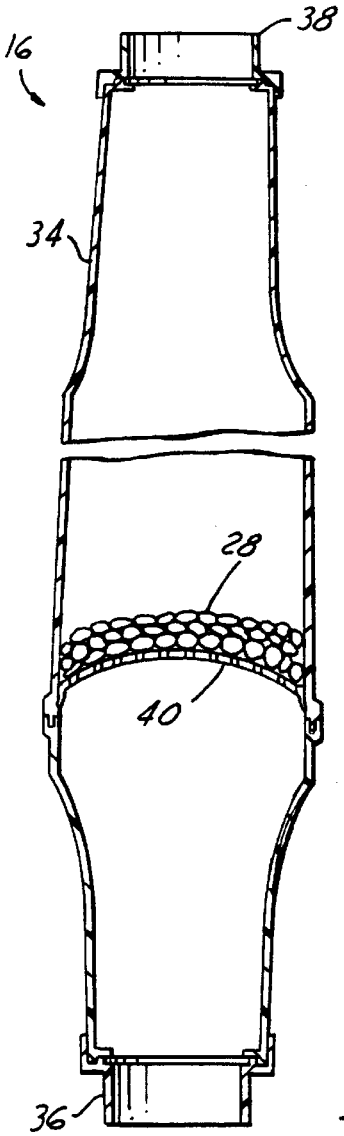
FIG. 2 is a perspective view of one of the embodiments of the present invention having a domed spring plate.

Referring now to FIG. 2, a carbon canister 16 is shown in accordance with one embodiment of the present invention. The canister 16 has a shell body 34, preferably molded from a hard plastic such as nylon, polypropylene, or high-density polyethylene. An open fuel vapor port 36 leads to the fuel vapor line 14 at one end, while an open vent port 38 leads to the canister vent line 18 on the other end. A dome spring plate 40 holds the carbon pellets 28 within a portion of the interior of the canister 16. The dome spring plate 40 is preferably composed of carbon steel but may also be composed of a hard plastic. Further, the dome spring plate 40 preferably has a flexible epoxy coating applied to the outer surface of the carbon steel spring plate 40 to prevent degradation.

Figure 2A:
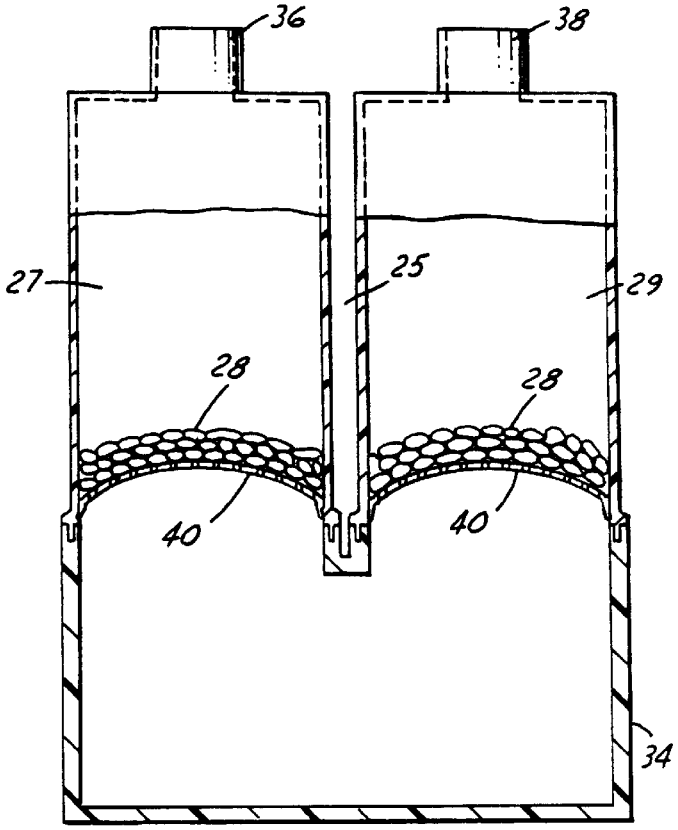
FIG. 2A is an alternative embodiment of FIG. 2 having a pair of domed spring plates.

Referring now to FIG. 2A, an alternative arrangement for the carbon canister 16 is shown. In this arrangement, the open vent port 38 and fuel vapor port 36 are both located along the top of the canister 16. A partial partition 25 in the shell body 34 separates a portion of the shell body 34 into a left chamber 27 and a right chamber 29. One dome spring plate 40 holds carbon pellets 28 within the left chamber 27, while a second dome spring plate 40 holds pellets 28 within the right chamber 29.

Figure 2B:
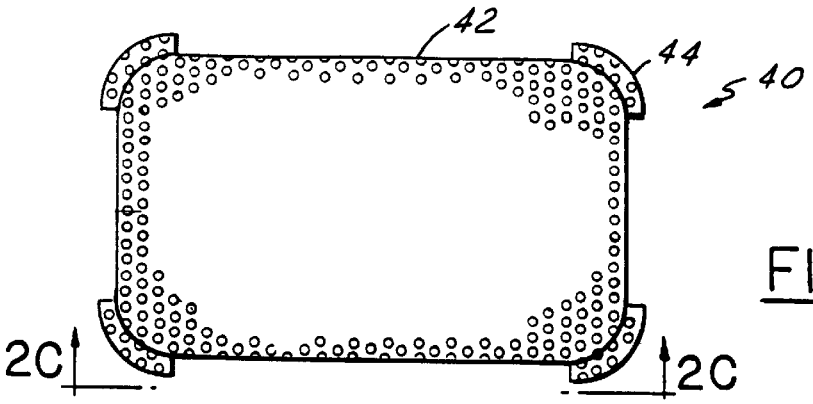
FIG. 2B is an enlarged view of the domed spring plate of FIGS. 2 and 2A.
Figure 2C:
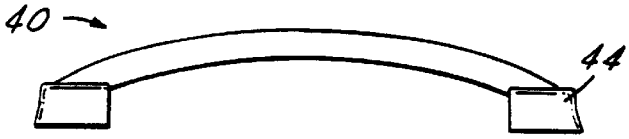
FIG. 2C is a side view of FIG. 2B.

As best illustrated in FIGS. 2B and 2C, the dome spring plate 40 contains perforations 42 that allow fuel vapor and air to flow freely through the canister 16. The perforations 42, however, are not large enough to allow the carbon pellets 28 to flow through. The dome spring plate 40 also contains a wiper seal 44. The wiper seal 44 provides mechanical interference with the inside of the shell body 34 (or partition 25) and "digs into" the inside walls of the shell body 34 for positive and life-long retention. The dome spring plate 40 is preformed into a spring of sufficient force and deflection to compensate for the expected compaction of the carbon pellets 28 over the usable life of the canister 16.

Figure 3:
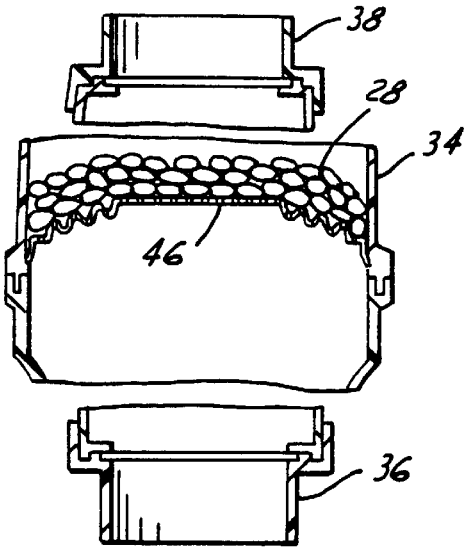
FIG. 3 is a perspective view of one of the embodiments of the present invention having a convoluted domed spring plate.

Referring now to FIG. 3, the carbon canister 16 is shown according to another embodiment of the present invention. The canister 16 has a shell body 34, preferably molded from a hard plastic. An open fuel vapor port 36 leads to the fuel vapor line 14 at one end, while an open vent port 38 leads to the canister vent line 18 on the other end. A convoluted dome spring plate 46 holds the carbon pellets 28 within a portion of the interior of the canister 16. The convoluted dome spring plate 46 is preferably composed of metal. Further, the convoluted dome spring plate 46 preferably has a flexible epoxy coating applied to its outer surface to prevent degradation.

Figure 3A:
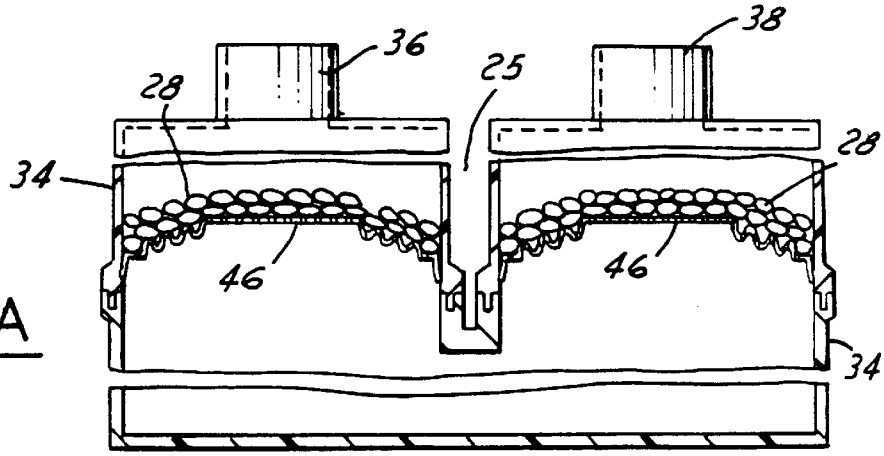
FIG. 3A is an alternative embodiment of FIG. 2 having a pair of convoluted domed spring plates.

Referring now to FIG. 3A, an alternative arrangement for the carbon canister 16 is shown. In this arrangement, the open vent port 38 and fuel vapor port are both located along the top of the canister 16. A partial partition 25 in the shell body 34 separates a portion of the shell body 34 into a left chamber 27 and a right chamber 29. One convoluted dome spring plate 46 holds carbon pellets 28 within the left chamber 27, while a second convoluted dome spring plate 46 holds pellets 28 within the right chamber 29.

Figure 3B:
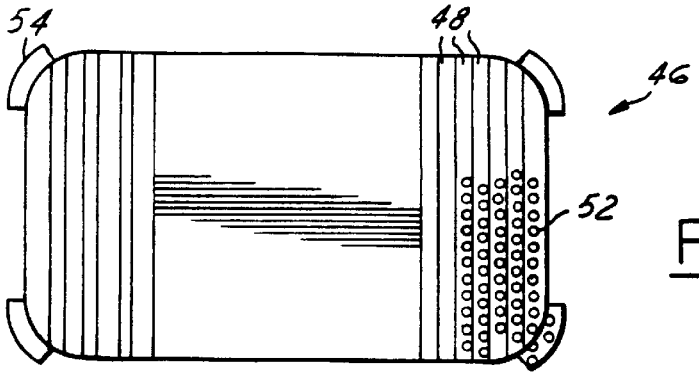
FIG. 3B is an enlarged view of the convoluted domed spring plate of FIGS. 3 and 3A.
Figure 3C:
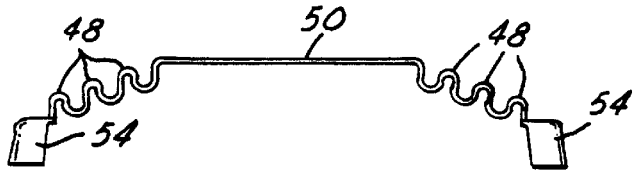
FIG. 3C is a side view of FIG. 3B.

As best illustrated in FIGS. 3B and 3C, the convolute dome spring plate 46 contains a series of convolutes 48 on each end of a substantially flat portion 50. In addition, the convolute dome spring plate 46 has perforations 52 that allow fuel vapor and air to flow freely through the canister 16. The perforations 52, however, are not large enough to allow the carbon pellets 28 to flow through. The convolute dome spring plate 46 also contains a wiper seal 54 coupled to the other side of the series of convolutes 48. The wiper seal 54 provides mechanical interference with the inside of the shell body 34 and "digs into" the inside walls of the shell body 34 for positive and life-long retention. The convolute dome spring plate 46 is preformed into a spring of sufficient force and deflection to compensate for the expected compaction of the carbon pellets 28 over the usable life of the canister 16.

Figure 4:
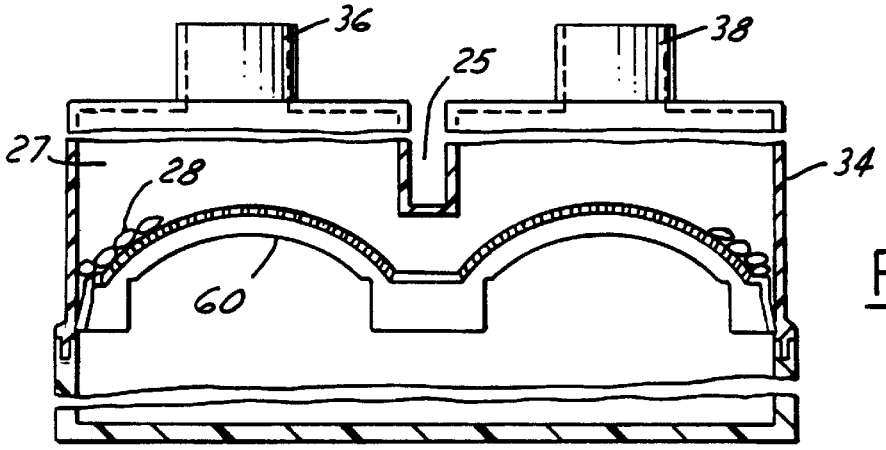
FIG. 4 is a perspective view of one of the embodiments of the present invention having a double domed spring plate.

Referring now to FIG. 4, the carbon canister 16 is shown according to one embodiment of the present invention. The canister 16 has a shell body 34, preferably molded from a hard plastic. An open fuel vapor port 36 leads to the fuel vapor line 14 while an open vent port 38 leads to the canister vent line 18. A double dome spring plate 60 holds the carbon pellets 28 within a portion of the interior of the canister 16 containing a partition 25. The double dome spring plate 60 is preferably composed of carbon steel, but may also be a hard plastic. Further, the carbon steel double dome spring plate 60 preferably has a flexible epoxy coating applied to its outer surface to prevent degradation.

Figure 4A:
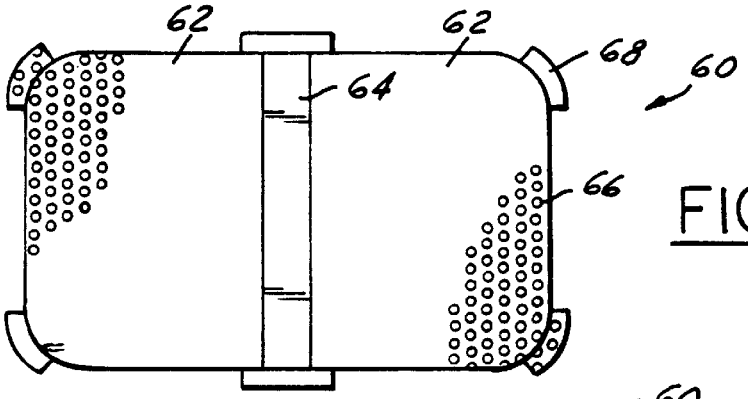
FIG. 4A is an enlarged view of the double domed spring plate of FIG. 4.
Figure 4B:
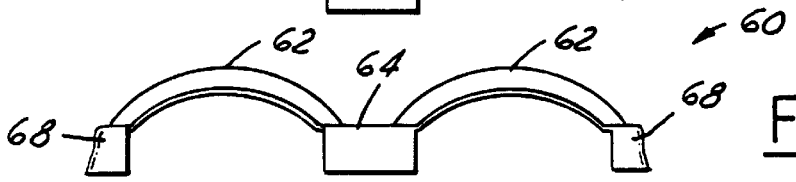
FIG. 4B is a side view of FIG. 4A.

As best illustrated in FIGS. 4A and 4B, the double dome spring plate 60 has two domes 62 separated by a central portion 64. The double dome spring plate 60 also contains perforations 66 that allow fuel vapor and air to flow freely through the canister 16. The perforations 66, however, are not large enough to allow the carbon pellets 28 to flow through. The double dome spring plate 60 also contains a wiper seal 68. The wiper seal 68 provides mechanical interference with the inside of the shell body 34 and "digs into" the inside walls of the shell body 34 for positive and life-long retention. The dome spring plate 60 is preformed into a spring of sufficient force and deflection to compensate for the expected compaction of the carbon pellets 28 over the usable life of the canister 16.

Figure 5:
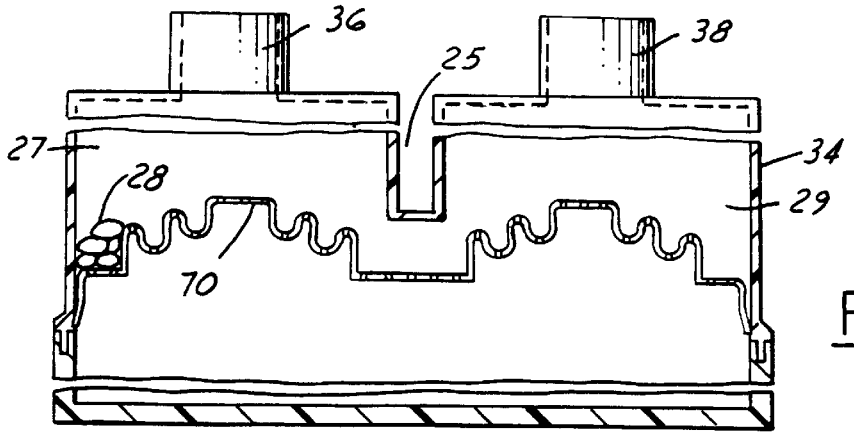
FIG. 5 is a perspective view of one of the embodiments of the present invention having a convoluted double domed spring plate.

Referring now to FIG. 5, the carbon canister 16 is shown according to one embodiment of the present invention. The canister 16 has a shell body 34, preferably molded from a hard plastic. An open fuel vapor port 36 leads to the fuel vapor line 14, while an open vent port 38 leads to the canister vent line 18. A double dome convoluted spring plate 70 holds the carbon pellets 28 within a portion of the interior of the canister 16. The double dome convoluted spring plate

70 is preferably composed of carbon steel, but may also be composed of a hard plastic. Further, the carbon steel double dome convoluted spring plate 70 preferably has a flexible epoxy coating applied to its outer surface to prevent degradation.

Figure 5A:
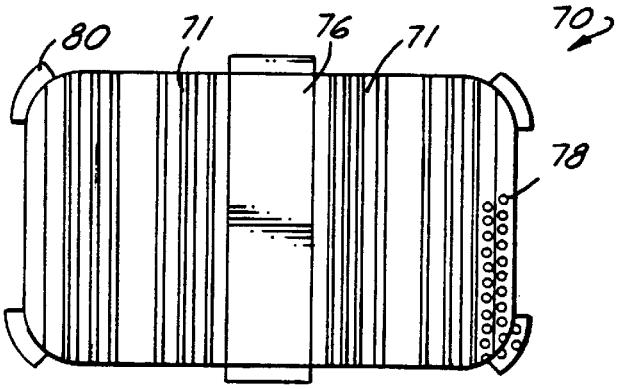
FIG. 5A is an enlarged view of the convoluted double domed spring plate of FIG. 5.
Figure 5B:
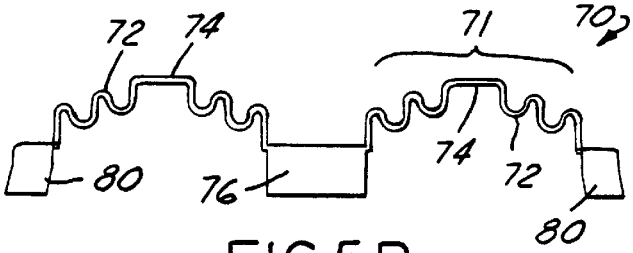
FIG. 5B is a side view of FIG. 5A.

As best illustrated in FIGS. 5A and 5B, the double dome convoluted spring plate 70 has two convoluted domes 71 separated by a central portion 76. Each of the domes 71 is comprised of two series of convolutions 72 on opposite sides of a lower portion 74. The double dome convoluted spring plate 70 also contains perforations 78 that allow fuel vapor and air to flow freely through the canister 16. The perforations 78, however, are not large enough to allow the carbon pellets 28 to flow through. The double dome convoluted spring plate 70 also contains a wiper seal 80. The wiper seal 80 provides mechanical interference with the inside of the shell body 34 and "digs into" the inside walls of the shell body 34 for positive and life-long retention. The double dome convoluted spring plate 70 is preformed into a spring of sufficient force and deflection to compensate for the expected compaction of the carbon pellets 28 over the usable life of the canister 16.

Figure 6:
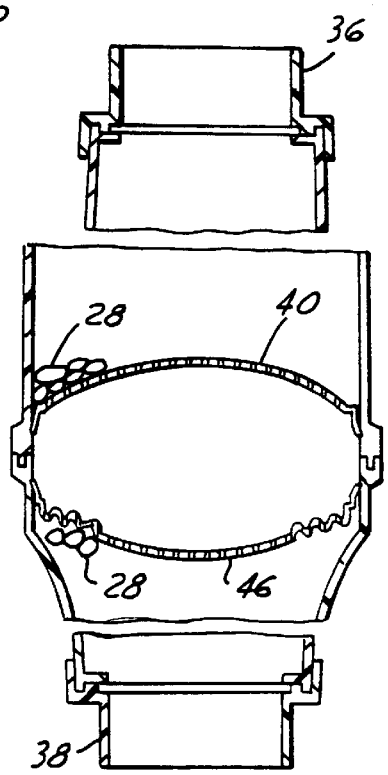
FIG. 6 is a perspective view of another embodiment of the preferred invention having two spring plates.

Referring now to FIG. 6, another alternative arrangement is illustrated wherein the canister 16 has a shell body 34, preferably molded from a hard plastic such as nylon, polypropylene, or high density polyethylene. An open fuel vapor port 36 leads to the fuel vapor line 14 at one end, while an open vent port 38 leads to the canister vent line 18 on the other end. One dome spring plates 40 (or, alternatively, a convoluted dome spring plate 46) holds the carbon pellets 28 within an upper portion 91 of the interior of the canister 16, while another dome spring plate 40 (or, alternatively, a convoluted dome spring plate 46) holds a second portion of carbon pellets 28 within a lower portion 93 of the inferior of the canister. A middle portion 95 between the two dome plates 40 contains no carbon pellets. The dome spring plate 40 is preferably composed of carbon steel but may also be composed of a hard plastic. Further, the dome spring plate 40 preferably has a flexible epoxy coating applied to the outer surface e of the carbon steel spring plate 40 to prevent degradation.

While the shape of the spring plate s 40, 46, 50, 60 are illustrated as being substantially rectangular as shown in FIGS. 2A–5A, it is specifically con templated that they may be any shape to be accommodated within the canister shell 34 such that the wiper seals 44, 54, 68, 80 substantially seal ("dig into") the inside of the canister shell 34 to prevent leakage of the carbon pellets 2. For instance, where the inside of canister shell 34 is substantially round, the spring plates 40, 46, 50, 60 are substantially round.

The carbon canister 16 according to the present invention offers many advantages as compared with conventional carbon canisters. First, the current design of the spring plates 40, 46, 50, 60 limits or eliminates carbon pellet 28 leakage resulting from 25 expansion or contraction of the carbon canister shell body 34 relative to the spring plate 40, 46, 50, 60. The wiper seals 44, 54, 68, 80 of the four embodiments illustrated allows the spring plate 40, 46, 50, 60 to shift up and down within the shell body 34 while maintaining a seal with the shell body 34 in response to the expansion or contraction of the shell body 34.

Second, the wiper seals 44, 54, 68, 80 maintain constant mechanical pressure on the carbon pellets 28 over the usable life of the vehicle (not shown) they are contained within.

Third, the present invention simplifies the design of the carbon canister 16 by eliminating the need to mold-in spring posts to the carbon canister 16.

Fourth, the present invention simplifies the design of a carbon canister 16 by combining the bed compression plate and spring of conventional carbon canisters into one single part.

Fifth, the spring plates 40, 46, 50, 60 can be easily formed into various shapes and sizes. Thus, they may be used in many other kinds of systems.

While the invention has been described in terms of preferred embodiments, it will be understood, of course, that the invention is not limited thereto since modifications may be made by those skilled in the art, particularly in light of the foregoing teachings.

What is claimed is:

1. A fuel vapor storage canister for use in a fuel vapor storage system, the fuel vapor storage canister comprising:

a shell body having an open fuel vapor port and an open vent port;

an active material capable of adsorbing fuel vapors contained within said shell body;

a spring plate for maintaining constant mechanical pressure on said active material within said shell body;

said spring plate having a plurality of perforations, each of said plurality of perforations being smaller in size than the size of said active material; and said spring plate also having a wiper seal along its outer periphery, said spring plate capable of moving upward or downward within said shell body while maintaining substantial sealing of said wiper seal to an inside portion of said shell body to prevent leakage of said active material.

2. The fuel vapor storage canister of claim 1, wherein said active material is pelletized carbon.

3. The fuel vapor storage canister of claim 1, wherein said active material is granular carbon.

4. The fuel vapor storage canister of claim 1, wherein said spring plate is domed-shaped.

5. The fuel vapor storage canister of claim 1, wherein said spring plate comprises a series of convolutions on each side of a flat portion.

6. The fuel vapor storage canister of claim 1, wherein said spring plate is a convoluted spring plate.

7. The fuel vapor storage canister of claim 1, wherein said spring plate is a double dome convoluted spring plate.

8. The fuel vapor storage canister of claim 1, wherein said spring plate is composed of carbon steel.

9. The fuel vapor storage canister of claim 8, wherein a flexible epoxy coating is applied to said carbon steel spring plate.

10. The fuel vapor storage canister of claim 1 further comprising:

a second active material capable of adsorbing fuel vapors contained within said shell body;

a second spring plate capable of maintaining constant mechanical pressure on said second active material within said shell body;

said second spring plate having a second plurality of perforations, the circumference of each of said second plurality of perforations smaller than the size of said second active material; and said second spring plate also having a second wiper seal along its outer periphery, said second spring plate capable of moving upward or downward within said shell body while maintaining substantial sealing of said second wiper seal to an inside portion of said shell body to prevent leakage of said second active material.

11. A spring plate for use in a fuel vapor adsorption canister, the fuel vapor adsorption component in the canister consisting of an active material, the spring plate comprising:

a plate having a plurality of perforations; and a wiper seal formed integrally along the outer periphery of said plate.

12. The spring plate of claim 11, wherein said plate comprises a domed plate.

13. The spring plate of claim 11, wherein said plate comprises a series of convolutions on each side of a central domed portion.

14. The spring plate of claim 11, wherein said plate comprises two domes separated by a substantially flat central portion.

15. The spring plate of claim 11, wherein said plate comprises two convoluted domes separated by a substantially flat central portion.

16. The spring plate of claim 11, wherein said plate and said wiper seal are composed of carbon steel.

17. The spring plate of claim 16, wherein a flexible epoxy coating is applied to said carbon steel plate and said carbon steel wiper seal.

18. A fuel evaporative control system for use in a fuel vapor storage system, the fuel evaporative control system having a fuel tank, a fuel vapor line for coupling the fuel tank to a fuel vapor storage canister, a fresh air vent line for coupling the fuel vapor storage canister to fresh air, a dust/filter separator coupled to the fresh air vent line, and a vapor management valve for coupling the fuel vent line to the engine, the fuel vapor storage canister comprising:

a shell body having an open fuel vapor port and an open vent port;

said open fuel vapor port coupled to the fuel vapor line;

said open vent port coupled to the fresh air vent line;

an active material capable of adsorbing fuel vapors contained within said shell body;

a spring plate for maintaining constant mechanical pressure on said active material within said shell body;

said spring plate having a plurality of perforations, each of said plurality of perforations being smaller in size than the size of said active material; and said spring plate also having a wiper seal along its outer periphery, said wiper seal capable of moving upwardly or downwardly within said shell body in response to thermal expansion or contraction of said shell body while maintaining substantial sealing to an inside portion of said shell body to prevent leakage of said active material.

19. The fuel vapor storage canister of claim 18, wherein said spring plate is domed-shaped.

20. The fuel vapor storage canister of claim 18, wherein said spring plate comprises a series of convolutions on each side of a flat portion.

21. The fuel vapor storage canister of claim 18, wherein said spring plate is a convoluted spring plate.

22. The fuel vapor storage canister of claim 18, wherein said spring plate is a double dome convoluted spring plate.

23. A method for retaining active material within a shell body of a fuel vapor storage canister, the method comprising the steps of:

introducing the active material to the shell body; and mechanically pressing a perforated spring plate having a wiper seal within the shell body such that the integrity of the active material is maintained, wherein said wiper seal substantially seals to an inside portion of the shell body to prevent leakage of the active material, and wherein said wiper seal is capable of moving upwardly or downwardly within the shell body in response to thermal expansion or contraction of the shell body.

24. The method of claim 23, wherein the step of introducing the active material to the shell body comprises the step of introducing a plurality of carbon pellets to the shell body.

25. The method of claim 23, wherein the step of mechanically pressing a perforated spring plate having a wiper seal within the shell body comprises the step of mechanically pressing a perforated domed spring plate having a wiper seal within the shell body.

26. The method of claim 23, wherein the step of mechanically pressing a perforated spring plate having a wiper seal within the shell body comprises the step of mechanically pressing a perforated convoluted domed spring plate having a wiper seal within the shell body.

27. The method of claim 23, wherein the step of mechanically pressing a perforated spring plate having a wiper seal within the shell body comprises the step of mechanically pressing a perforated double domed spring plate having a wiper seal within the shell body.

28. The method of claim 23, wherein the step of mechanically pressing a perforated spring plate having a wiper seal within the shell body comprises the step of mechanically pressing a perforated convoluted double domed spring plate having a wiper seal within the shell body.

* * * * *